United States Patent [19]

Menelly et al.

[11] 4,263,349

[45] Apr. 21, 1981

[54] CORROSION RESISTANT COATING

[76] Inventors: Richard A. Menelly, 34 Merriam St.; Francis X. Doyle, 74 Dawes Ave., both of Pittsfield, Mass. 01201

[21] Appl. No.: 66,845

[22] Filed: Aug. 15, 1979

Related U.S. Application Data

[63] Continuation of Ser. No. 893,498, Apr. 4, 1978, abandoned.

[51] Int. Cl.[3] ..... B05D 3/10; B05D 1/36

[52] U.S. Cl. ..... 427/352; 427/353; 427/409

[58] Field of Search ..... 427/409, 352, 353

[56] References Cited

U.S. PATENT DOCUMENTS 3,859,116 1/1975 Townsend ..... 427/409

*Primary Examiner*—James R. Hoffman

*Attorney, Agent, or Firm*—Richard A. Menelly; Francis X. Doyle

[57] ABSTRACT

Corrosion resistance is provided to metal substrates by the application of a hydrophobic resinous substance containing slightly alkaline particles in suspension. When applied to the metal substrate surface the cured resin provides a controlled diffusion barrier to the particles contained therein. Upon exposure to a liquid medium containing dissolved acid salts the alkaline substance leaches through the coating to neutralize the solution. The corrosion resistant coating is especially effective as an automotive finish primer and an autobody undercoat.

5 Claims, 7 Drawing Figures

CORROSION RESISTANT COATING

This is a continuation of application Ser. No. 893,498 filed Apr. 4, 1978, now abandoned.

BACKGROUND OF THE INVENTION

The increasing usage of chemical salts as melting agents in combination with sand to promote traction upon winter roads causes increased damage to the metal undercarriage of vehicles using the roads. The splashing of surface water containing salts results in a chemical reaction between the metal undercarriage and the particular chemicals involved. A common road treating chemical such as calcium chloride in the presence of water can form a dilute hydrochloric acid substance which attacks the metal on contact.

The application of protective coating compositions such as that described, for example in U.S. Pat. No. 3,313,635 delays the deterioration process to a certain extent but is not completely effective. The use of sand with the salt material causes the protective coating composition to become mechanically abraded to such an extent that the salt-containing liquid permeates through to the metal. In some instances, particularly when the vehicles are stored in overnight heated garages, severe metal erosion exists under an otherwise intact coating of undercoat material. The liquid diffuses through the undercoat carrying the corrosive salts in solution for reacting at the temperatures provided within the heated garage enclosure. Removing intact layers of undercoat material reveals badly eroded metal substrates which remain undetected until holes appear in the opposite metal surface.

The erosion of the metal undercarriages is especially severe in northern regions of the United States where hundreds of thousands of tons of salt and sand are applied in the course of a particularly severe winter season. Otherwise operable vehicles are discarded in most instances since the rusting is not discovered until such a state of deterioration has occurred that replacement and repair becomes prohibitively expensive.

The purpose of this invention is to provide methods and materials for providing long-term protection to metal surfaces exposed to heavy concentrations of acid materials.

SUMMARY OF THE INVENTION

Chemically alkaline powders are suspended in hydrophobic resin compositions to provide a tough adherent alkaline powder coating when the resin becomes cured. The resin material provides a controlled diffusion membrane between the alkaline powder and the resin surface. In the presence of acid-containing liquids minute quantities of the alkaline substance leach through the resin to neutralize the acid material.

One embodiment of the invention consists in the combination of a mixture of phenolic resin and linseed and tung oils containing a suspension of calcium carbonate powder. A further embodiment of the invention comprises a suspension of sodium bicarbonate powder in an oil base varnish.

DESCRIPTION OF THE PREFERRED EMBODIMENT

In an attempt to combine an alkaline powder material within an envelope of a hydrophobic plastic material which is only slightly pervious to water for causing the alkaline material to leach out in a controlled rate, various alkaline powders and resins were considered. One alkaline substance-resin composition that could be combined without causing a reaction between the resin and the alkaline material was the suspension of sodium bicarbonate powder in a mixture of phenolic resin with linseed and tung oils. An effective amount of sodium bicarbonate powder was approximately 75 grams per 100 cc of a varnish composition consisting of approximately 11.7 percent phenolic resin, 30.1 percent by weight linseed and tung oils and the remainder consisting of liquid mineral spirits and dryers. It was found that the sodium bicarbonate suspended readily within the resin composition without causing the resin to react. Stable suspensions of the bicarbonate powder could be obtained up to approximately 125 grams per 100 cc of resin material without causing the suspension to become thixotropic.

In order to determine the effectiveness of the phenolic resin, after curing, for controlling the reaction rate between water and the sodium bicarbonate powder a plurality of plastic containers were coated with one or more coats of the sodium bicarbonate-resin suspension. After allowing the resin to dry overnight the plastic containers were filled with tap water and a series of pH readings were taken over an extended period of time in order to determine whether the water would penetrate the resin envelope and cause the sodium bicarbonate powder to leach into solution.

Figure 1:
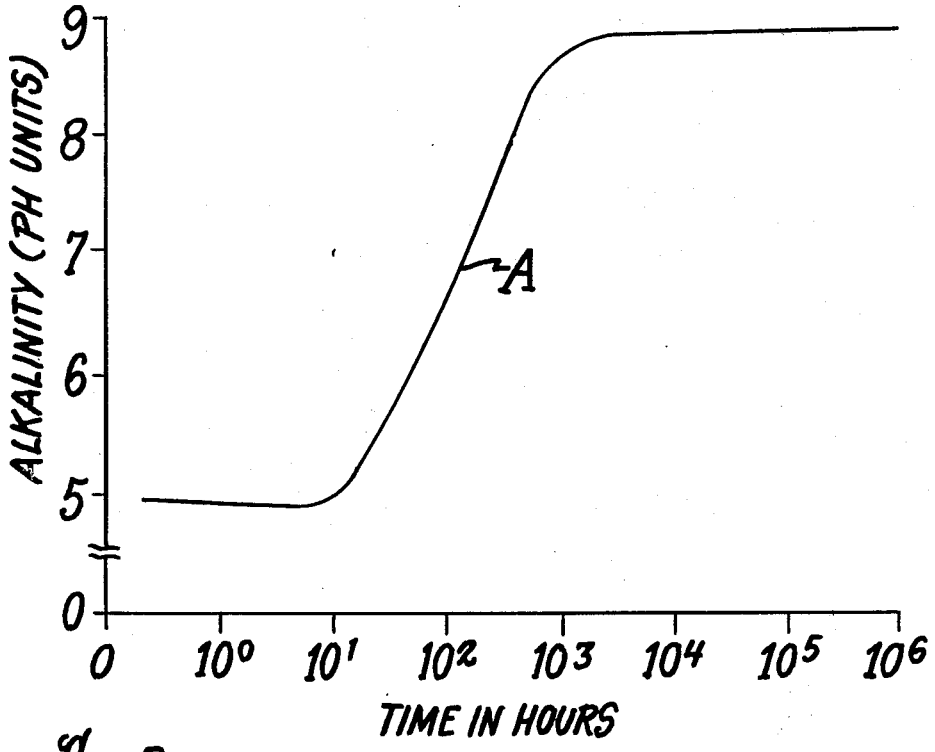
FIG. 1 is a graphic representation of the increase in alkalinity with time for the coating of the invention totally submersed in water.

FIG. 1 shows the alkalinity of the water within the plastic test container over an extended period of time. The pH reading at time zero is the pH indication of the tap water employed. It is to be noted that no measurable increase in pH occurred up to approximately 10 hours. For a period of from 10 to 1,000 hours the pH continuously increased up to a maximum value of 9.0 and thereafter remained at a constant high value. Comparison test samples including a solution of sodium bicarbonate within tap water and not containing the resin material exhibited a pH indication of 9.0. The condition of the sodium bicarbonate-containing resin was constantly observed over the test duration in order to determine whether the resin material deteriorated and caused the sodium bicarbonate to become completely dissolved within the water. The varnish resin material was chosen of a clear transparent consistency so that visual observations could be maintained as to the condition of the resin coating as well as to the condition of the dispersed powder particles. The powder materials remained within the resin encapsulent without becoming wet or in any way indicating that complete dissolution occurred.

Figure 2:
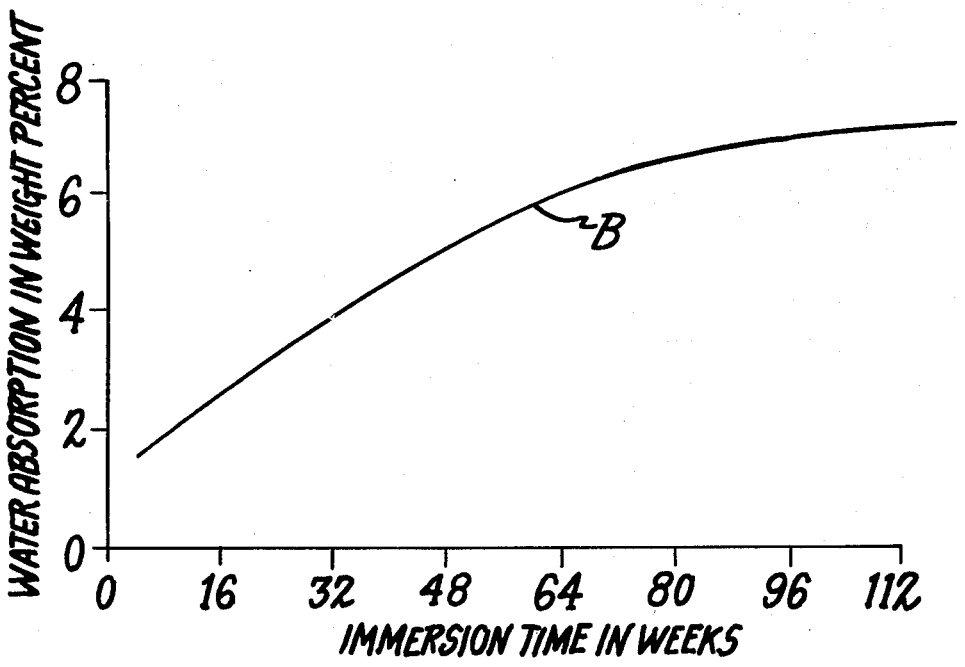
FIG. 2 is a graphic representation of the quantity of water absorbed by a plastic material as a function of immersion time in water.

FIG. 2 is a published curve representing the rate of water absorption B as a function of time for a cast phenol formaldehyde resin completely immersed in water. It is to be noticed that even with the resin totally immersed in water the absorption rate is so slow that less than 10 percent by weight is absorbed out to a few hundred weeks. The phenolic resin was one of the constituents selected for the clear varnish composition utilized for the data represented in FIG. 1.

Figure 3:
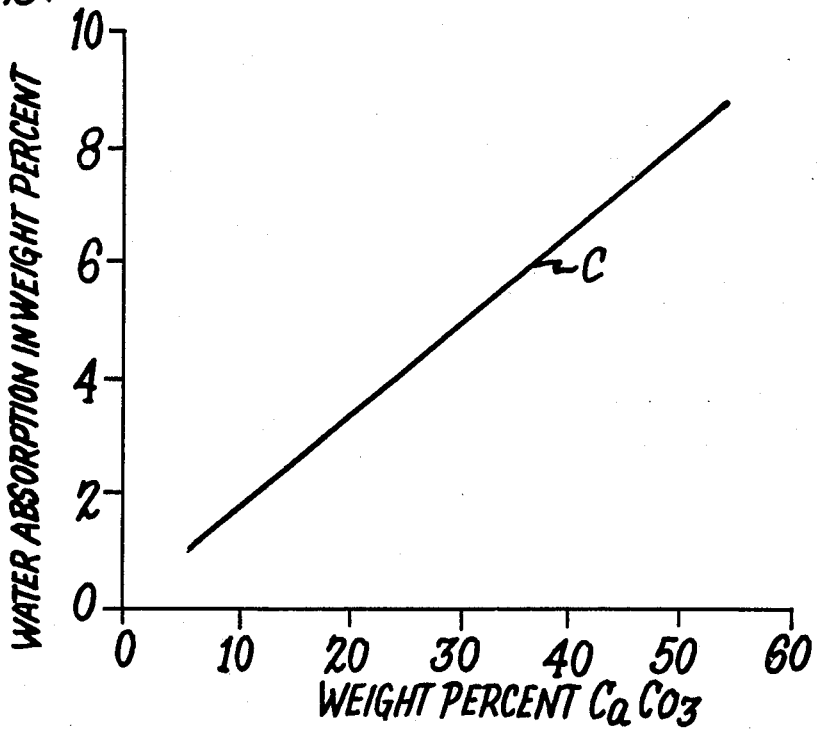
FIG. 3 is a graphic representation of the quantity of water absorbed as a function of the quantity of calcium carbonate powder in a varnish suspension.

Substituting calcium carbonate for the sodium bicarbonate as a slightly alkaline powder for encapsulating within a resin to form a second corrosive resistant coating provides equally satisfactory results. FIG. 3 shows the estimated water absorption C in weight percent as a function of the weight percent calcium carbonate powder within the resin suspension in dried films. The reason for the continuous increase in water absorption for resin containing calcium carbonate powder is due to the decreased thickness of the resin envelope in the cured film for a fixed quantity of resin material. At very low concentrations of calcium carbonate the film thickness is quite large and for a correspondingly large quantity of calcium carbonate the film thickness is correspondingly thinner. The rate of diffusion through the film is a relatively constant function of the film material so that the quantity absorbed is directly related to the film thickness.

In order to have long-range corrosion inhibiting benefits the inventive coating must continuously leach the slightly alkaline powder over susstained periods of time.

Figure 4:
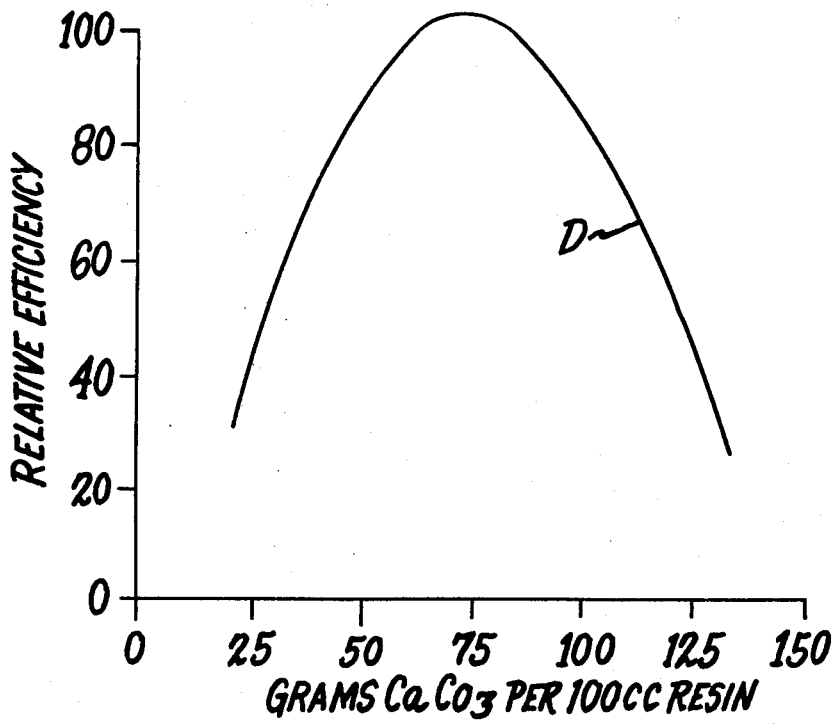
FIG. 4 is a graphic representation of the relative efficiency of the corrosive resistant material of the invention as a function of the quantity of calcium carbonate per weight of resin material in the coating suspension.

If the alkaline powder material leaches at too rapid a rate the neutralizing affects will be short-lived relative, for example, to the estimated life of an American automobile. If the leaching occurs at too slow a rate then there is question as to whether any neutralization affects will occur at all. The relative efficiency of a coating composition based on the aforementioned phenolic resin mixed with the linseed and tung oils with calcium carbonate powder is shown at D in FIG. 4. For concentrations of calcium carbonate less than 20 percent for example, the operating efficiency of the coating is low due to the long leaching times involved. For concentrations in excess of 125 grams of calcium carbonate per 100 cc of resin the leaching occurs at such a rapid rate that the calcium carbonate powder is quickly used up and no longer effective as a neutralizing agent. The resin composition for the data shown in FIG. 4 was a liquid suspension containing mineral solvents and having the consistency of a medium viscosity paint. Although the sodium bicarbonate and calcium carbonate are equally effective for the purpose of neutralizing road salt solutions the calcium carbonate is preferred when the road salt comprises calcium chloride and the sodium bicarbonate is preferred when the road salt comprises sodium chloride.

Figure 5:
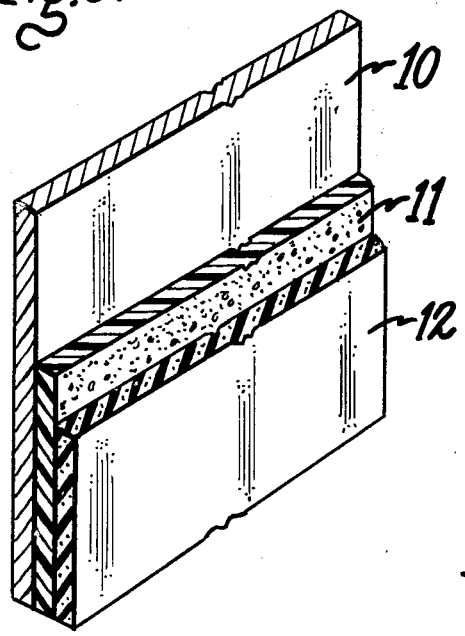
FIG. 5 is perspective view in partial section of a metal substrate containing the coating of the invention in combination with an undercoat.
Figure 6:
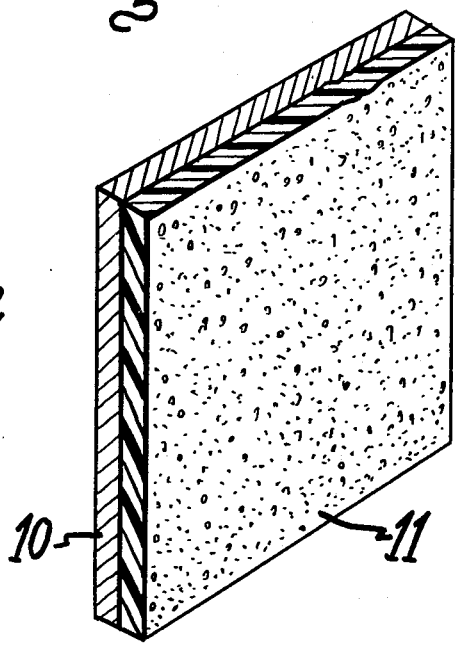
FIG. 6 is a top perspective view in partial section of the coating of the invention on a metal substrate without an undercoat.

When the corrosive composition of the invention is used as a protective coating for vehicle undercarriages the coating can be used in cooperation with a standard undercoat material such as described in the aforementioned U.S. Patent, or as a substitute for the undercoat. FIG. 5 shows a metal substrate 10 similar, for example, to an automobile body having the corrosive resistant coating of the invention 11 applied directly to the substrate. For the purposes of this disclosure the inventive corrosive resistant coating will be termed "underguard" to distinguish from the standard so-called "undercoat" material commonly used for the protection of vehicle undercarriages. A standard undercoat material 12 can be coated over the underguard coating in order to provide further protection against abrasion and non-acidic type of corrosion materials such as gasolines and oils. FIG. 6 depicts the method of applying the underguard coating 11 directly to the bare metal substrate 10 as a direct replacement for the undercoating. For the embodiment of FIG. 6 the thickness of the underguard 11 must be sufficient to provide protection also against the abrasive effects of sand and small stones which impinge upon the vehicle undercarriage.

Figure 7:
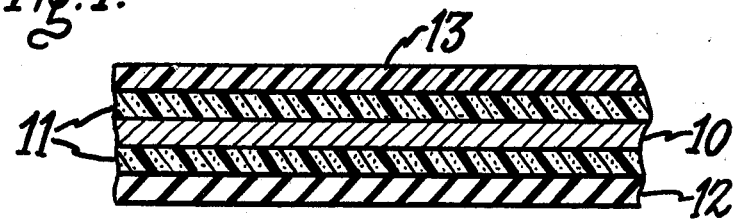
FIG. 7 is a sectional view of a metal substrate coated on both sides with the corrosion resistant coating of the invention.

An ideal method of completely protecting automotive bodies against road salt corrosion is shown in FIG. 7. Here the metal substrate 10 could be for example the metal comprising an automotive fender. The bottom part of the substrate 10 could comprise the interior portion of the fender facing the tire and the upper portion of substrate 10 could be the exterior painted portion of the fender. The substrate on the lower half is coated with a first layer of underguard material covered with a heavy layer of undercoat 12. The upper portion of metal substrate 10 contains a first layer of underguard material used in combination with or substitution for the metal primer commonly used with automotive finishes. The exterior finish 13 is then applied over the underguard coating. The embodiment depicted in FIG. 7 would give complete protection to both sides of the automotive fender by neutralizing any droplets of acidic material that permeates through the finish or contacts the metal through pinholes or chips in the finish coating.

Although the disclosed resin composition comprises a mixture of phenolic resin with tung and linseed oils in a varnish-like composition this is by way of example only. Other natural resins or artificial plastic resins may also be employed providing the solvent used does not react with the alkaline powders and providing the alkaline powders do not react with the particular resin employed. Epoxy type resins are particularly suitable as well as nitrocellulose and ethylcellulose resins.

Although the corrosion resistive coating of the invention is described in particular application for use with automobiles and the like this is by way of example only. The corrosion resistive coating of the invention finds application wherever metal surfaces are to be protected from acidic environments.

We claim:

1. A method for protecting metal substrates from corrosion comprising the steps of:

applying an alkaline coating to a metal substrate said coating consisting of a suspension of an alkaline powder within a plastic resin and leaching the alkaline powder from the resin upon contact with acid substances.

2. The method of claim 1 further including the step of applying an abrasion resistant undercoat material over the alkaline coating.

3. The method of claim 1 further including the step of applying a coating of paint over the alkaline coating.

4. The method of claim 1 wherein the plastic resin includes a phenolic resin.

5. The method of claim 1 wherein the alkaline powder is selected from the group consisting of sodium bicarbonate and calcium carbonate.

* * * * *